US006761652B1

(12) United States Patent
Chen et al.

(10) Patent No.: US 6,761,652 B1
(45) Date of Patent: Jul. 13, 2004

(54) FINISHING COLLAR FOR GRIP TAPE AND METHOD OF WRAPPING A HANDLE

(76) Inventors: Sam H. Chen, 7057 Florey St., San Diego, CA (US) 92122; C. F. Chang, 403, Sec. 2, Sha-Tien Road, Ta-Tu, Taichung (TW), 432

( * ) Notice: Subject to any disclaimer, the term of this patent is extended or adjusted under 35 U.S.C. 154(b) by 0 days.

(21) Appl. No.: 10/349,515

(22) Filed: Jan. 21, 2003

(51) Int. Cl.[7] ..... A63B 49/08
(52) U.S. Cl. ..... 473/549; 473/568; 473/300
(58) Field of Search ..... 473/549, 553, 473/568, 300; 16/110 R; 81/489

(56) References Cited

U.S. PATENT DOCUMENTS 1,648,175 A * 11/1927 Hamel et al. ..... 473/298
2,672,342 A * 3/1954 Griffin ..... 473/549
5,069,452 A * 12/1991 Chen ..... 473/549
5,335,919 A * 8/1994 Soong ..... 473/551
5,816,933 A 10/1998 Huang
6,244,975 B1 6/2001 Huang
6,361,450 B1 * 3/2002 Huang ..... 473/300
6,386,989 B1 5/2002 Huang
6,551,198 B2 * 4/2003 Huang ..... 473/300

FOREIGN PATENT DOCUMENTS

FR 2662948 * 12/1991 ..... A63B/49/08

* cited by examiner

*Primary Examiner*—Raleigh W. Chiu
(74) *Attorney, Agent, or Firm*—Mary Jo Redman; Calif Tervo

(57) ABSTRACT

Finishing collar 10 for securing an end 97 of grip tape 95 wrapped upon a handle 80; including locking ring 20, first flange 36 for overlying and retaining grip tape 95, and second flange 37 for covering any gap between finishing collar 10 and shank portion 84 of handle 80. Finishing collar 10 is of durable stretchy material such as rubber and is under tension in use.

10 Claims, 1 Drawing Sheet

FINISHING COLLAR FOR GRIP TAPE AND METHOD OF WRAPPING A HANDLE

FIELD OF THE INVENTION

This invention relates in general to handles with tape wrapping, and more specifically to handles of sports racquets wrapped with grip tape.

BACKGROUND OF THE INVENTION

Sports racquets, such as used in tennis, often have a portion of the handle wrapped with grip tape to provide a more secure grip for the hand and to cushion shock. Grip tape is typically fastened at the butt end of the handle and wrapped helically up the grip portion of the handle. The grip tape often has an underlayer of adhesive, but the wrapped end is generally additionally secured such that the grip tape can not unwind.

A typical manner of securing the end of the tape is to wind a small strip of adhesive tape over the last wrap of the grip tape. The strip of securing tape is wrapped straight around the handle, that is, perpendicular to the longitudinal axis, so that it is more resistant to being rolled up by forces from the user's hand during play than the grip tape is.

There are several disadvantages associated with the securing tape. Because it has an exposed end, it is also somewhat prone to being rolled or unraveled, although less so than the grip tape. The adhesive may creep over a long period of time to make a sticky edge around the securing tape that attracts grit and lint. The securing tape is generally not as attractive as grip tape, which typically has a decorative surface. Once securing tape starts to unravel, it is difficult to re-stick it securely and the user must replace it.

Thus, there is a need for a more durable means for securing the end of grip tape to finish the wrap, that is attractive, easy to install, and inexpensive to manufacture.

SUMMARY OF THE INVENTION

The present invention is a finishing collar for securing an end of a piece of grip tape that is wrapped upon a handle, such as of a tennis racquet. The finishing collar is generally a hollow cylinder in shape before it is installed upon the handle. The finishing collar is made of a tough, resilient material, such as a synthetic elastomeric compound. The finishing collar is stretched to pass the hollow cylinder over the handle from the butt end.

A preferred embodiment of the finishing collar includes a locking ring that locks into an existing feature of the handle to prevent sideways (parallel to longitudinal axis of handle) movement of the collar. The locking ring has two broad, thin flanges attached on opposite sides of the ring. The locking ring preferably has a smaller inside circumference than the outside circumference of the part of the handle on which the ring will be seated.

To install the finishing coliar on a wrapped handle, the locking ring is stretched enough that it can pass over the butt end of the handle. The collar is placed just "above" the point at which it will be seated, that is, near the point but slightly toward the head of the racquet. The grip tape is wrapped in typical fashion, with the last turn of tape being wrapped just below the finishing collar. The first flange, extending toward the wrapped tape, is folded or rolled upon itself so that the tape can be wrapped nearly up to the locking ring. The first flange then is unrolled or unfolded such that the first flange covers the last wrap of the tape, including the free end.

The first flange preferably has an inside circumference slightly less than the perimeter of the wrapped handle, so that the flange is in a stretched state after covering the tape. The resilience of the flange causes it to conform closely to the underlying tape and to resist being dislodged accidentally.

The second flange, which extends toward the head of the racquet, is disposed to smooth over any gap or disparity of height between the wrapped grip tape and the unwrapped portion of the handle. The second flange also acts to stabilize the finishing collar and prevent it from being rolled or dislodged.

Because the finishing collar is a closed cylinder, it cannot be unraveled or come loose. It does not include adhesive, so that edge stickiness is not a problem. Because the finishing collar is a unit with a fixed circumference, a logo or other decorative feature may be included on the outer surface of the finishing collar. Attempting to include a logo on adhesive retaining tape is not satisfactory, because the design is likely to be crooked or partially obscured after the piece of tape is wrapped around the free end of the grip tape.

If it is desired to change or re-wrap the grip tape, it is easy to move the finishing collar from the retaining position to release the old grip tape. After wrapping new grip tape, the finishing collar is re-used to retain the free end of the new wrapping, without degradation of the finishing collar's strength or durability. However, the finishing collar is not typically dislodged accidentally during use of the racquet.

The features and advantages of the invention will be readily understood when the detailed description thereof is read in conjunction with the accompanying drawings wherein like reference numerals refer to like parts throughout.

DETAILED DESCRIPTION OF THE INVENTION

Figure 1:
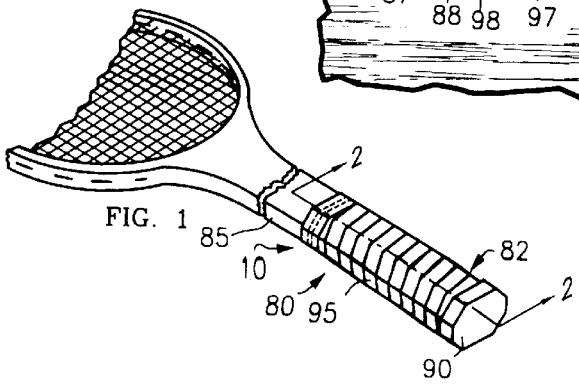
FIG. 1 is a perspective environmental view of the finishing collar installed on a grip-tape-wrapped handle.
Figure 3:
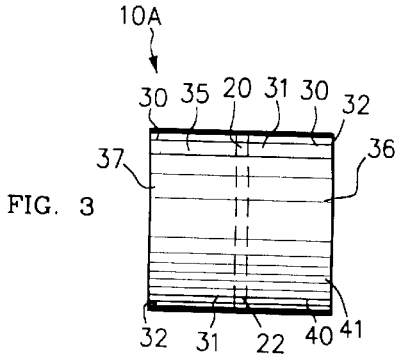
FIG. 3 is a side elevation view of a preferred embodiment of the finishing collar of FIG. 1.
Figure 4:
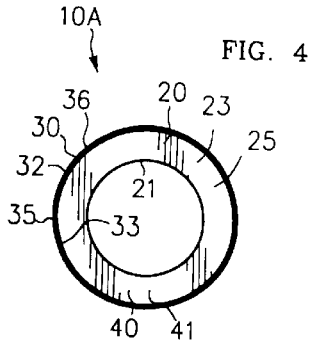
FIG. 4 is a right end view of the finishing collar of FIG. 3.

FIG. 1 is a perspective environmental view of a first embodiment 10A of the finishing collar 10 installed on a grip-tape-wrapped handle 80. FIG. 3 is a side elevation view of embodiment 10A of FIG. 1. FIG. 4 is a right end view of finishing collar 10A of FIG. 3.

The finishing collar 10 generally comprises a locking ring 20 and a pair of flanges 30. Locking ring 20 is a ring having an inner face 21 that faces the racquet, an outer face 22 that faces outward, side walls 20, including a first side wall 25 and a second side wall 26, connecting inner face 21 and outer face 22, a first flange 36 attached to first side wall 25, and a second flange 37 attached to second side wall 26.

Finishing collar 10 is preferably made of a tough, resilient material, such as latex rubber, EPDM, polyurethane, or similar materials. Finishing collar 10 can be cast or molded as a unit, or formed as a long hollow tube that is cut into pieces of the proper length.

Figure 2:
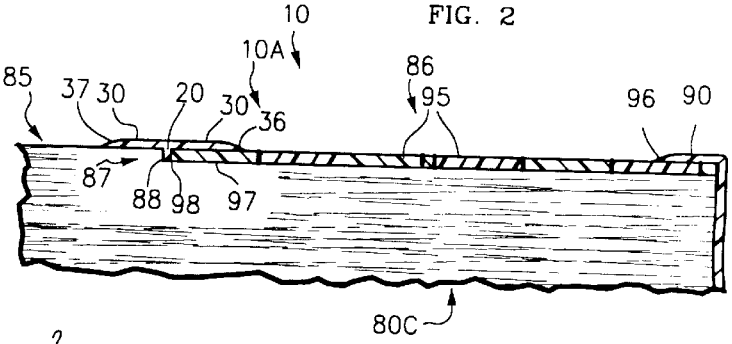
FIG. 2 is an enlarged, partial sectional view of the handle of FIG. 1, taken upon line 2—2 of FIG. 1.

FIG. 2 is an enlarged partial sectional view of handle 80 of FIG. 1, taken upon line 2—2 of FIG. 1. Handle 80 is shown in FIG. 2 to have a recessed grip tape receiving portion 86 for wrapping grip tape 95 into. Handle 80 having a recessed grip tape receiving portion 86 is denoted handle 80C.

Handle 80 typically includes a notch feature 87. Notch feature 87 refers to a small portion of surface 85 of shank portion 84 of handle 80 that is generally perpendicular to the longitudinal axis of handle 80. In the case of handle 80C with recessed grip tape receiving portion 86, notch feature 87 is a notch wall 88 that connects shank portion 84 to grip tape receiving portion 86.

In FIG. 2, grip tape receiving portion 86 is wrapped with grip tape 95 for improving the grip and cushioning the shock of impacts. First end 96 of grip tape 95 is secured to butt end 82 of handle 80C by end cap 90. Grip tape 95 is wound helically around grip tape receiving portion 86 with a small gap left between grip tape 95 and notch feature 87, namely notch wall 88. Locking ring 20 seats against notch wall 88 and locks finishing collar 10A against lateral movement toward the shank portion 84.

To wrap handle 80C with grip tape 95, a piece of grip tape 95 of appropriate length is cut. Locking ring 20 is stretched to pass over butt end 82 and finishing collar 10 is moved upward toward shank portion 84 of handle 80C until locking ring 20 is against notch wall 88. First flange 36 is folded or rolled back so that free edge 32 of first flange 36 is disposed over locking ring 20 or second flange 37.

First end 96 of grip tape 95 is attached to butt end 82, such as by pressing end cap 90 over first end 96 and butt end 82. End cap 90 remains in place on butt end 82 by friction fit. Grip tape 95 is wound up grip tape receiving portion 86 and second end 97 of grip tape 95 ends up close to locking ring 20. First flange 36 is unfolded or unrolled to its original position, such that inside face 33 of first flange 36 overlies second end 97 of grip tape 95 and secures second end 97.

As mentioned above, finishing collar 10 is of stretchy, resilient material. Finishing collar 10 is dimensioned such that inner face 21 has a circumference slightly smaller than the perimeter of grip tape receiving portion 86 of handle 80C. Locking ring 20 is thus in tension when installed upon handle 80C, such that friction resists movement of locking ring 20 along the longitudinal axis of handle 80C.

First flange 36 is dimensioned such that inside face 33 has smaller circumference than the total perimeter of the wrapped handle 80C. First flange 36 is in tension when disposed over grip tape 95 such that first flange conforms tightly to grip tape 95 and secures second end 97 from unwinding.

Preferred embodiment 10A of the invention also includes a second flange 37 attached to second side wall 26 and extending laterally. Flange 37 is disposed so as to cover any gap between locking ring 20 and notch wall 87 when installed on handle 80C.

Figure 6:
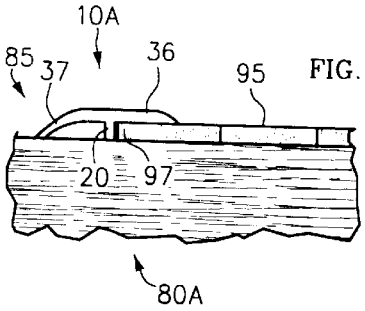
FIG. 6 is a sectional view, partly cut away, of the finishing collar of FIG. 3 installed upon an alternative handle.
Figure 7:
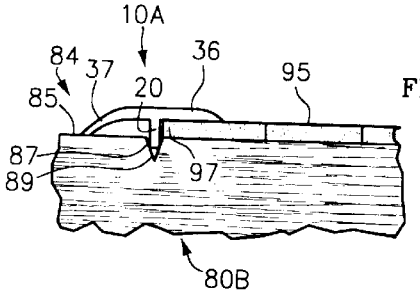
FIG. 7 is a sectional view, partly cut away, of the finishing collar of FIG. 3 installed upon an another alternative handle.

FIGS. 6 and 7 depict other types of handle 80 in sectional view, partly cut away. Handle 80A of FIG. 6 has a grip tape receiving portion 86 that is not recessed. In this example, finishing collar 10A is prevented form movement toward shank portion 84 by friction. First flange 36 secures second end 97 of grip tape 95 from unwinding and locking ring 20 protects the upper edge of wrapped grip tape 95 from being rolled up or dislodged. Second flange 37 smoothes the difference in height between the top of grip tape 95 and surface 85 of shank portion 84.

Handle 80B of FIG. 7 includes a notch feature 87 that is a simple circumferential groove 89. Locking ring 20 is adapted to seat in groove 89, locking finishing collar 10A against lateral movement in either direction. Second flange 37 smoothes the difference in height between the top of grip tape 95 and the surface of shank portion 85.

Figure 5:
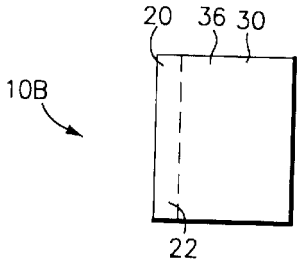
FIG. 5 is a side elevation view of an alternative embodiment of the invention.
Figure 8:
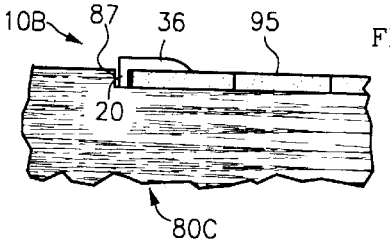
FIG. 8 is a sectional view, partly cut away, of the finishing collar of FIG. 5, installed upon the handle of FIG. 2.

FIG. 5 is a side elevation view of an alternative preferred embodiment of the invention 10B. Finishing collar 10B includes a first flange 36 but no second flange 37. FIG. 8 is a side sectional view, partly cut away, of finishing collar 10B installed upon a handle 80C.

Herein, finishing collar 10 has been described as generally cylindrical and having a circumference. Alternatively, finishing collar 10 may be made having a rectangular, elliptical, or other transverse cross-sectional shape that would conform upon stretching to the shape of a handle. The description of the invention and the claims should be read as including other shapes, as will be apparent to those skilled in the art.

It will also be apparent to those skilled in the art that the invention may be adapted for use with alternative designs of handle that are not detailed herein.

The foregoing is a description of two exemplary embodiments of a durable, easy to install, attractive finishing collar for securing grip tape wrapped on a handle, which is constructed in accordance with principles of this invention. It is likely that changes and modifications will occur to those skilled in the art which are within the inventive concepts disclosed and claimed herein.

We claim:

1. In combination:

a handle including:

a longitudinal axis;

a shank portion;

a grip tape receiving portion for being wrapped with grip tape and having a smaller circumference than said shank portion; and a notch wall spanning the radial distance between said grip tape receiving portion and said shank; and a finishing collar including:

a locking ring for encircling the handle and for locking said collar against movement along the longitudinal axis of the handle; including:

an inner face facing the handle;

an outer face opposite said inner face; and a first side wall between said inner face and said outer face; and a first flange attached to said first side wall and extending laterally outward from said attached first side wall; said first flange for covering and retaining an end of the grip tape.

2. The combination of claim 1, said locking ring further including: a second side wall opposite said first side wall; and a second flange attached to and extending laterally outward from said second side wall; said second flange for smoothing any difference in perimeter between the wrapped grip tape and said shank portion, and for further stabilizing said finishing collar against movement along the longitudinal axis of said handle.

3. The combination of claim 2, said locking ring being adapted to fit within a gap between the wrapped grip tape and said notch wall such that said locking ring is thereby locked against movement in either direction along the longitudinal axis of said handle.

4. The combination of claim 3, said finishing collar composed of elastomeric material.

5. The combination of claim 4, said inner face having an inner circumference that is less than the perimeter of said grip tape receiving portions.

6. The combination of claim 5, said first flange having an inner circumference less than the perimeter of the wrapped grip tape.

7. The combination of claim 6, said first flange being thin and flexible enough to be folded or rolled back upon itself in order to facilitate positioning said first flange over the free end of the grip tape.

8. The combination of claim 7, said second flange having an inside circumference less than the perimeter of said shank portion.

9. A method for wrapping a handle using grip tape and finishing the wrap with a finishing collar including: a locking ring for encircling the handle and retaining an end of the grip tape and a flange attached to and extending laterally from the locking ring; and the handle including: a shank portion; a grip tape receiving portion; and a notch feature; including the steps of:

attaching an end of a piece of grip tape to an end of the grip tape receiving portion of the handle opposite the shank portion;

winding the grip tape helically around the grip tape receiving portion of the handle such that a gap remains between the last turn of the grip tape and the notch feature of the handle, the gap being at least as wide as the locking ring of the finishing collar;

installing the finishing collar by fitting the locking ring into the gap between the grip tape and the notch feature; and disposing the flange such that the flange overlies the last turn of the grip tape and secures the grip tape from unwinding.

10. The method of claim 9, wherein the collar further includes: a first flange attached to a first side of the locking ring; and a second flange attached to a second side wall of the locking ring; the first and second flanges extending laterally in opposite directions; further including the steps of:

disposing the first flange such that the first flange overlies the free end of the wrapped grip tape and secures the end; and disposing the second flange such that the second flange covers any gap between the locking ring and the shank portion and smoothes any difference in perimeter between the locking ring and the shank portion.

* * * * *